US009033856B2

(12) United States Patent
Messerschmid

(10) Patent No.: US 9,033,856 B2
(45) Date of Patent: May 19, 2015

(54) FOLDING MANDREL, DEVICE AND METHOD FOR MANUFACTURING GLUED SLEEVES

(75) Inventor: Uwe Messerschmid, Albershausen (DE)

(73) Assignee: MICHAEL HOERAUF MASCHINENFABRIK GMBH U. CO. KG, Donzdorf (DE)

( * ) Notice: Subject to any disclaimer, the term of this patent is extended or adjusted under 35 U.S.C. 154(b) by 837 days.

(21) Appl. No.: 12/653,980

(22) Filed: Dec. 18, 2009

(65) Prior Publication Data

US 2010/0173764 A1 Jul. 8, 2010

(30) Foreign Application Priority Data

Dec. 22, 2008 (DE) ..... 10 2008 064 505

(51) Int. Cl.
*B31B 1/00* (2006.01)
*B31C 3/04* (2006.01)
*B31C 7/02* (2006.01)

(52) U.S. Cl.
CPC .... *B31C 3/04* (2013.01); *B31C 7/02* (2013.01)

(58) Field of Classification Search
USPC ..... 493/153, 175, 84, 152, 154
See application file for complete search history.

(56) References Cited

U.S. PATENT DOCUMENTS

| | | | | |
|---|---|---|---|---|
| 2,581,539 | A * | 1/1952 | Keith | 493/85 |
| 3,733,980 | A | 5/1973 | Palmer et al. | |
| 4,242,949 | A | 1/1981 | Auckenthaler | |
| 4,250,798 | A | 2/1981 | Yamato et al. | |
| 4,718,961 | A | 1/1988 | Yamato et al. | |
| 6,287,247 | B1 * | 9/2001 | Dees et al. | 493/58 |
| 7,549,273 | B2 * | 6/2009 | Dart et al. | 53/463 |
| 7,614,993 | B2 * | 11/2009 | Van Handel | 493/155 |
| 7,828,199 | B2 * | 11/2010 | Robertson et al. | 229/198.2 |
| 8,146,796 | B2 * | 4/2012 | D'Amato | 206/505 |
| 2006/0196923 | A1 * | 9/2006 | Tedford | 229/403 |

FOREIGN PATENT DOCUMENTS

| | | | |
|---|---|---|---|
| DE | 28 54 586 | A1 | 6/1979 |
| DE | 29 07 841 | A1 | 11/1979 |
| JP | 2003-276721 | A | 10/2003 |

OTHER PUBLICATIONS

Office Action from German Patent Office dated Apr. 18, 2012 for German Application No. DE 10 2008 064 505.2 (6 pages).
Office Action issued in China Patent Application No. 200910262236.1 dated Dec. 3, 2012 (3 pages).

* cited by examiner

*Primary Examiner* — Sameh H. Tawfik
(74) *Attorney, Agent, or Firm* — Flynn, Thiel, Boutell & Tanis, P.C.

(57) ABSTRACT

Folding mandrel, device and method for manufacturing glued sleeves. The invention relates to a folding mandrel for a device for manufacturing glued sleeves, in particular paper sleeves for the manufacture of paper cups, where the folding mandrel is provided for winding of a plane segment and is so dimensioned that in the wound-on state of the segment an overlap containing adhesive is obtained. In accordance with the invention, the folding mandrel is provided with at least one recess for receiving any adhesive escaping from the overlap.

22 Claims, 2 Drawing Sheets

FOLDING MANDREL, DEVICE AND METHOD FOR MANUFACTURING GLUED SLEEVES

FIELD OF THE INVENTION

The invention relates to a folding mandrel for a device for manufacturing glued sleeves, in particular paper sleeves for the manufacture of paper cups, where the folding mandrel is provided for winding of a plane segment and is so dimensioned that in the wound-on state of the segment an overlap containing adhesive is obtained. The invention also relates to a device and to a method for manufacturing glued sleeves.

BACKGROUND OF THE INVENTION

Known folding mandrels for manufacturing glued sleeves for the manufacture of paper cups have a conical form onto which a plane paper segment is wound. Before winding on of the paper segment, adhesive is applied is an area in which an overlap is to be provided. After being wound onto the folding mandrel, the segment is compressed in the area of the overlap and the segment is connected to form a conical sleeve. To save paper, the overlap is selected as small as possible, and it can then not be completely ruled out that adhesive escapes from the overlap. If adhesive escapes on that side of the overlap facing the folding mandrel, this causes fouling of the folding mandrel surface. This can lead to sticking of the sleeves and to disruptions in the production sequence. To eliminate and prevent such disruptions, the folding mandrel must be cleaned regularly. If adhesive escapes on the other side of the overlap, this escaped adhesive is on the outside of the finished cup. If several cups are then stacked inside one another after completion, this can lead to the stacked cups sticking together.

SUMMARY OF THE INVENTION

The invention is intended to provide an improved folding mandrel, an improved device and an improved method for manufacturing glued sleeves, in particular paper sleeves for the manufacture of paper cups.

In accordance with the invention, a folding mandrel for a device for manufacturing glued sleeves, in particular paper sleeves for the manufacture of paper cups, is provided for this purpose, where the folding mandrel is provided for winding of a plane segment and is so dimensioned that in the wound-on state of the segment an overlap containing adhesive is obtained, where the folding mandrel is provided with at least one recess for receiving any adhesive escaping from the overlap.

Surprisingly, it is possible, by the simple provision of a recess in the surface of the folding mandrel onto which the segment is wound, to completely solve the problem of fouling by escaping adhesive. The recess is arranged in the area of or even immediately adjacent to a segment edge limiting the area of the overlap and contacting the folding mandrel. At this segment edge, adhesive may escape when the overlap is pressed together and can then spread into the recess inside the folding mandrel. The overlap contains adhesive applied to the segment sections forming the overlap. Tests have shown that when a recess is provided in the folding mandrel for receiving any escaping adhesive, operating disruptions due to the finished sleeve sticking to the folding mandrel can be completely prevented and that a previously routine cleaning of the folding mandrel can also be substantially completely dispensed with.

In an embodiment of the invention the recess is designed as a groove.

The course of the groove can here be adapted to the course of the overlap and the paper segment is wound onto the folding mandrel such that the segment edge contacting the folding mandrel is arranged above or directly adjacent to the groove. The entire length of this segment edge then has thanks to the groove sufficient space to receive any escaping adhesive.

In an embodiment of the invention, the groove extends at least over the full length of the sleeve contacting the folding mandrel. The groove can run parallel to a longitudinal axis of the folding mandrel.

In standard sleeves made of segments in circular arc section shape, the segment edge contacting the folding mandrel and limiting the overlap is usually straight, so that it can be placed without problem inside the area of a groove running parallel to the longitudinal axis of the folding mandrel.

In an embodiment of the invention, edges are designed rounded at the transition between the recess and a winding surface of the folding mandrel.

In this way, catching of the wound-on segment on such edges can be dependably avoided and any. cleaning of the recess that may be needed is facilitated.

The problem underlying the present invention is also solved by a device for manufacturing glued sleeves, in particular paper sleeves for the manufacture of paper cups, that has a folding mandrel in accordance with the invention for winding of a plane segment, application means for applying adhesive to the segment in the area of a provided overlap of the segment wound onto the folding mandrel, and pressing means for pressing together the wound-on segment in the area of the overlap on the folding mandrel, where the pressing means are designed to close a gap between the segment sections forming the overlap, initially in the area of an outside segment edge contacting the segment and subsequently in the direction of an inside segment edge contacting the winding surface of the folding mandrel.

Thanks to these measures, It can be achieved that adhesive does not escape at the segment edge contacting the segment, but at the most at the segment edge contacting the folding mandrel. This ensures that no escaped adhesive can be found on the outside of the finished sleeve. Any adhesive escaping on the inside of the sleeve during pressing on can be reliably received in the groove inside the folding mandrel. The pressing means can be designed for example in the form of a plunger that is brought into contact with the overlap first at an angle and then full-face.

The problem underlying the invention is also solved by a method for manufacturing glued sleeves, in particular paper sleeves for the manufacture of paper cups, with the following steps:

Application of adhesive in the area of an intended overlap of a segment to be wound on.

Winding of the segment on a folding mandrel, where a segment edge contacting a winding surface of the folding mandrel is arranged at least in some sections immediately adjacent to a recess in the winding surface.

In an embodiment of the invention, the step of pressing together the segment sections in the area of the overlap is provided, where during pressing together a gap between the segment sections forming the overlap is closed first in the area of an outside segment edge contacting the segment and then in the direction of an inside segment edge contacting the winding surface of the folding mandrel.

In this way, it can be reliably prevented that adhesive escapes at the outside segment edge, so that the outside of the manufactured sleeve is reliably free of adhesive.

In an embodiment of the invention, adhesive is applied in the form of cold glue, hot glue, hot-melt adhesive or primer.

The method in accordance with the invention is suitable for all types of adhesive, for example hot-melt adhesive can be applied as hot glue. The primer is an aqueous solution containing plastic, which is liquid and of low viscosity, is applied to the area of the overlap, and then sets and affixes chemically or thermally, for example.

In an embodiment of the invention, paper segments that are uncoated or plastic-coated on at least one side are wound on and glued.

The method in accordance with the invention is suitable for both coated and uncoated paper segments. Uncoated paper segments are used for example in the manufacture of outside sleeves that do not come into contact with liquid. Cup sleeves of an inner cup are then manufactured from paper coated at least on one side.

BRIEF DESCRIPTION OF THE DRAWINGS

Further features and advantages of the invention can be found in the claims and the following description of preferred embodiments of the invention in conjunction with the drawings. Individual features of the various embodiments can here be combined with one another as required without going beyond the scope of the invention. The drawings show in:

DETAILED DESCRIPTION

Figure 1:
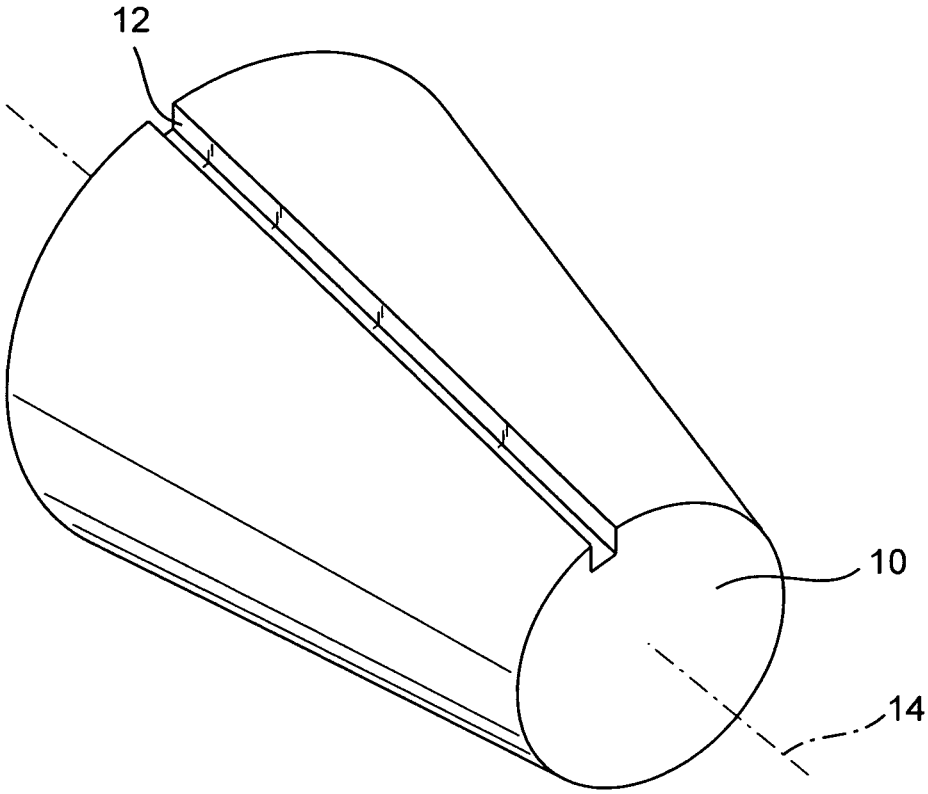
FIG. 1 a schematic and perspective view of a folding mandrel in accordance with the invention, FIG. 2 a front view of the folding mandrel of FIG. 1 with a wound-on paper segment, FIG. 3 an illustration of the unwound paper segment with applied adhesive, FIG. 4 an illustration of a section of the folding mandrel of FIG. 1 with wound-on paper segment before pressing on in the overlap area, FIG. 5 an illustration of the folding mandrel of FIG. 1 with wound-on paper segment during pressing on in the area of the overlap and FIG. 6 a schematic illustration of the folding mandrel of FIG. 1 with wound-on paper segment and differently designed pressing means.
Figure 3:
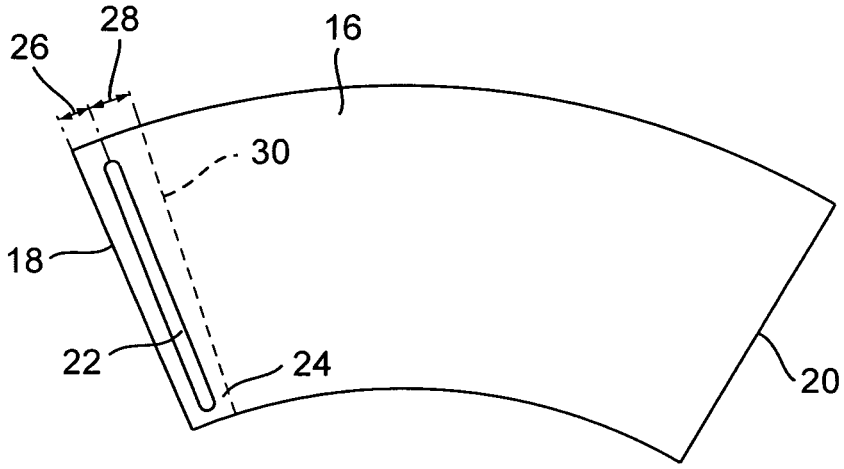

The view of FIG. 1 shows a folding mandrel 10 in accordance with the invention having a circular frustum shape and onto the circumferential surface of which a paper segment can be wound, as shown in FIG. 3 in the unwound state. The paper segment is so dimensioned here that after winding on an overlap is obtained allowing the paper segment to be glued in the area of the overlap, in order to then obtain a frustum-shaped sleeve. Such frustum-shaped sleeves can then be provided with a bottom in order to serve as an inner cup for holding beverages. Such frustum-shaped sleeves can also be slid onto inner cups in order to form an insulating cover when a double-walled paper cup is to be manufactured for holding hot beverages.

The folding mandrel 10 is provided with a groove 12 having a rectangular cross-section and extending from the cone surface of the folding mandrel 10 inwards in the direction of a central longitudinal axis 14 of the folding mandrel. The groove 12 is here parallel to the central longitudinal axis 14.

Figure 2:
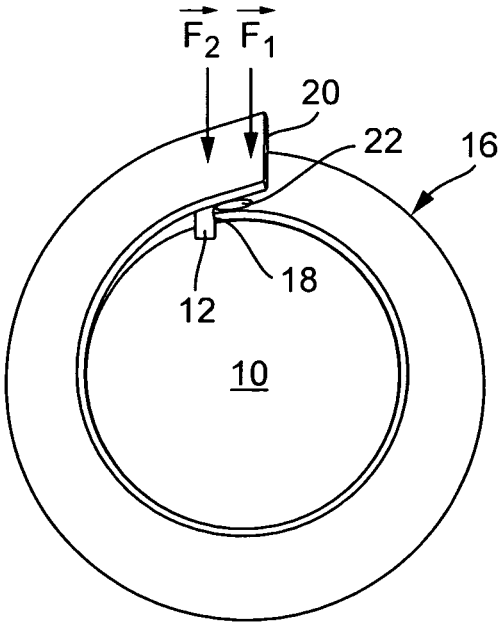

The illustration in FIG. 2 shows the folding mandrel of FIG. 1 with a wound-on paper segment 16. It can be readily discerned that a first segment edge 18 contacting the cone surface or winding surface of the folding mandrel 10 is arranged immediately adjacent to the groove 12. A second segment edge 20 which in the wound-on state contacts the segment 16 limits an overlap. The overlap is, as can be seen from FIG. 2, made between the first segment edge 18 and the second segment edge 20. An adhesive bead 22 is arranged between the overlapping segment areas. The adhesive bead 22 is here, see FIG. 3, only applied adjacently to the first segment edge 18 and ends up inside the overlap after winding.

To glue the paper segment 16 in the area of the overlap, and to manufacture a conical paper sleeve, the paper segment 16 must be pressed together in the area of the overlap. It is quite possible here that adhesive escapes from the overlap. Any adhesive escaping at the first segment edge 18 can spread into the groove 12 and hence not cause fouling of the winding surface of the folding mandrel 10. After removal of the finished paper sleeve, escaped adhesive can be found at the most inside the groove 12. The winding surface of the folding mandrel 10 onto which a new paper segment is wound is however dependably free of adhesive, so that no disruptions in production can occur due to sticking of a paper segment 16 on the folding mandrel 10.

An escape of adhesive at the upper or outside segment edge 20 is prevented firstly by a force F1 being exerted on the paper segment 16 immediately adjacent to the second segment edge 20. As a result, the gap between the second segment edge 20 and the area of the paper segment 16 underneath it is closed, so that the adhesive bead 22 is forced in the direction of the first segment edge 18. Once the gap underneath the second segment edge 20 is dosed by pressing by means of the force F1, the force F2 is then applied to press the overlap completely.

The adhesive bead 22, see FIG. 3, is also applied to the paper segment 16 in an area 24 where the overlap is later formed not centrally, but slightly offset towards the first segment edge 18. In the illustration in FIG. 3, it can be readily seen that the adhesive bead 22 is applied at a distance 26 from the segment edge 18, this distance 26 being smaller than the distance 28 between the adhesive bead 22 and a limit of the overlap indicated by the dashed line 30. The second segment edge 20 comes to rest on the dashed line 30 in the wound-on state of the paper segment 16.

Figure 4:
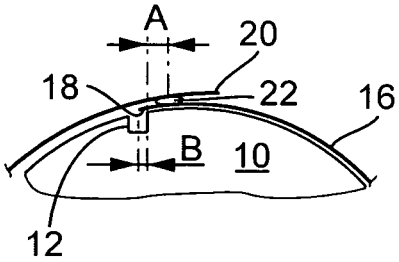

The illustration in FIG. 4 shows a section of the folding mandrel 10 of FIG. 1 onto which the paper segment 16 is wound. It can be seen that the first segment edge 18 comes to rest above the groove 12 and in particular protrudes by a distance B beyond the rim of the groove 12. It can be assured in this way that even if the first segment edge 18 is not arranged precisely parallel to the groove 12 when positioning the paper segment 16, no adhesive can get onto the winding surface of the folding mandrel 10, but only into the groove 12.

FIG. 4 furthermore indicates a distance A between the rim of the groove 12 and a central line of the adhesive bead 22. As already explained using FIG. 3, this distance A is smaller than a distance from a central line of the adhesive bead 22 to the second segment edge 20. This too ensures that no adhesive can escape at the segment edge 20 and then foul the outside of the finished paper sleeve.

Figure 5:
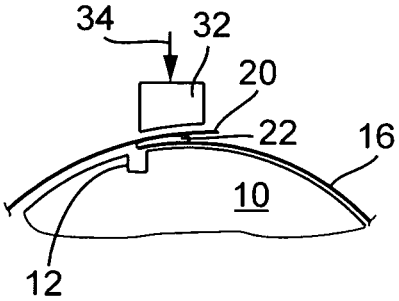

The illustration in FIG. 5 shows schematically the device in accordance with the invention with the folding mandrel 10, where a pressing plunger 32 is shown schematically that presses the folding mandrel 10 in the direction of the arrow 34 onto the paper segment 16 in the area of the overlap. It can be seen that the adhesive bead 22 is pressed flat and excess adhesive goes into the groove 12.

Figure 6:
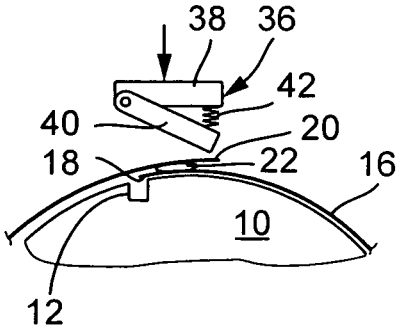

A further embodiment of a device in accordance with the invention is shown schematically in the illustration in FIG. 6. The paper segment 16 is again wound onto the folding mandrel 10, which is provided with the groove 12. A pressing plunger 36 has however a plunger surface 40 pivotably attached to a base 38 and is furthermore biased by means of a compression spring 42 into a position pushed away from the base 38. The plunger 40 will as a result exert pressure first on the overlap in the area of the second segment edge 20, corresponding to the force F1 shown in FIG. 2. When the compression spring 42 is then pressed together during further lowering of the base 38, the plunger 40 is in full-face contact with the overlap and presses the overlap together over its full surface, corresponding to the forces F1, F2 in FIG. 2. As a result however, the gap between the second segment edge 20 and the section of the paper segment 16 underneath it is first closed by the plunger 40, so that the adhesive bead 22 then can only spread in the direction of the first segment edge 18. As a result, any excess adhesive can escape at the most at the first segment edge 18.

The invention claimed is:

1. A method for manufacturing glued paper sleeves for manufacture of paper cups, the method comprising:

applying adhesive in an area of an intended overlap of a segment of paper to be wound; and winding the segment of paper on a folding mandrel, wherein an inside segment edge, which is not folded over, contacting a winding surface of the folding mandrel is arranged at least in some portions so as to protrude over a recess in the winding surface, the recess having a longitudinal dimension extending in a longitudinal direction substantially parallel to a central axis of the segment of paper wound on the folding mandrel, the recess staying empty during manufacture apart from receiving a portion of the adhesive escaping from the segment of paper.

2. The method according to claim 1, further including pressing together sections of the segment of paper in the area of the intended overlap, wherein during the pressing together a gap between the sections of the segment of paper is closed first in an area of an outside segment edge contacting the segment of paper and then in a direction of the inside segment edge.

3. The method according to claim 1, wherein applying the adhesive includes applying cold glue, hot glue, hot-melt adhesive or primer.

4. The method according to claim 1, wherein the segment is uncoated or plastic-coated on at least one side.

5. The method according to claim 1, wherein the recess is substantially linear.

6. The method according to claim 1, wherein the winding surface is frusto-conical.

7. The method according to claim 1, further including receiving the portion of the adhesive escaping from the segment of paper into the recess.

8. The method according to claim 1, wherein the winding surface of the folding mandrel lies on an imaginary conical surface and the recess is located radially inwardly from the imaginary conical surface.

9. The method according to claim 1, wherein the winding surface of the folding mandrel lies on an imaginary curved surface and the recess is located radially inwardly from the imaginary curved surface.

10. A method for manufacturing glued paper sleeves for manufacture of paper cups, the method comprising:

providing a piece of paper having a first end edge and a second end edge, sections of the piece of paper adjacent the first end edge and the second end edge defining an area of intended overlap;

providing a folding mandrel including a winding surface having a recess;

applying adhesive on the piece of paper in the area of intended overlap;

winding the piece of paper about the folding mandrel so as to contact the winding surface thereof;

positioning at least a portion of the first end edge of the piece of paper, which is not folded over, over the recess in the winding surface;

wherein providing the folding mandrel includes providing the folding mandrel with a circular cross section orientated perpendicular to a central axis of the piece of paper wound on the folding mandrel, with the recess extending longitudinally in a direction substantially perpendicular to a tangent of the circular cross section; and maintaining the recess empty during manufacture of the sleeve except for receiving a portion of the adhesive escaping from the piece of paper.

11. The method according to claim 10, wherein the recess is substantially linear.

12. The method according to claim 10, further including pressing together the sections of the piece of paper in the area of the intended overlap, pressing including pressing together a gap between the sections of the piece of paper to close the gap moving from the second end edge of the piece of paper overlying the piece of paper toward the first end edge of the piece of paper.

13. The method according to claim 10, wherein the winding surface is frusto-conical.

14. The method according to claim 10, further including receiving the portion of the adhesive escaping from the piece of paper into the recess.

15. The method according to claim 10, wherein the winding surface of the folding mandrel lies on an imaginary conical surface and the recess is located radially inwardly from the imaginary conical surface.

16. The method according to claim 10, wherein the winding surface of the folding mandrel lies on an imaginary curved surface and the recess is located radially inwardly from the imaginary curved surface.

17. A method for manufacturing glued paper sleeves for manufacture of paper cups, the method comprising:

providing a piece of paper having a first end edge and a second end edge, sections of the piece of paper adjacent the first end edge and the second end edge defining an area of intended overlap;

providing a folding mandrel including a winding surface having a substantially linear recess;

applying adhesive on the piece of paper in the area of intended overlap;

winding the piece of paper about the folding mandrel so as to contact the winding surface thereof;

positioning at least a portion of the first end edge of the piece of paper, which is not folded over, over the recess in the winding surface; and maintaining the recess empty during manufacture of the sleeve except for receiving a portion of the adhesive escaping from the piece of paper.

18. The method according to claim 17, further including pressing together the sections of the piece of paper in the area of the intended overlap, pressing including pressing together a gap between the sections of the piece of paper to close the gap moving from the second end edge of the piece of paper overlying the piece of paper toward the first end edge of the piece of paper.

19. The method according to claim 17, wherein the winding surface is frusto-conical.

20. The method according to claim 17, further including receiving the portion of the adhesive escaping from the piece of paper into the recess.

21. The method according to claim 17, wherein the winding surface of the folding mandrel lies on an imaginary conical surface and the recess is located radially inwardly from the imaginary conical surface.

22. The method according to claim 17, wherein the winding surface of the folding mandrel lies on an imaginary curved surface and the recess is located radially inwardly from the imaginary curved surface.

* * * * *